US005326527A

United States Patent [19]

Bodnar et al.

[11] Patent Number: 5,326,527

[45] Date of Patent: Jul. 5, 1994

[54] TITANIUM-BEARING LOW-COST STRUCTURAL STEEL

[75] Inventors: Richard L. Bodnar; Steven S. Hansen, both of Bethlehem, Pa.

[73] Assignee: Bethlehem Steel Corporation, Bethlehem, Pa.

[21] Appl. No.: 941,453

[22] Filed: Sep. 8, 1992

[51] Int. Cl.[5] ..... C22C 38/14

[52] U.S. Cl. ..... 420/126; 420/128

[58] Field of Search ..... 420/93, 126, 128

[56] References Cited

FOREIGN PATENT DOCUMENTS 50-80911 7/1975 Japan ..... 420/126

61-23742 2/1986 Japan ..... 420/126

OTHER PUBLICATIONS

J. S. Smaill et al., "Effect of titanium additions on strain-aging characteristics and mechanical properties of carbon-manganese reinforcing steels," *Metals Technology*, pp. 194-201 (1976).

L. A. Laduc et al., "Hot Rolling of C-Mn-Ti Steel," in *Thermomechanical Processing of Microalloyed Austenite*, pp. 641-654 (1982).

S. Ye, "Influence of Rolling and Cooling Process on Microstructure and Properties of C-Mn Steel Treated with Al-Ti-CaSi Combined Addition", *Iron steel (China)*, vol. 23(9), pp. 31-35 (1988).

Shyi-Chin Wang, "The Effect of Titanium and Nitrogen Contents on the Microstructure and Yield Streength of Plain Carbon Steels," *China Steel Technical Report*, No. 3, pp. 20-25 (1989).

F. B. Pickering, "Titanium nitride technology," in *Microalloyed Vanadium Steel*, pp. 79-95 (1990).

Tadeusz Siwecki et al., "Evolution of Microstructure During Recrystallization Controlled Rolling of HSLA Steels," in *Proc. of 33rd Mechanical Working and Steel Processing Conference* (Oct. 1991).

C. R. Killmore et al., "Titanium Treated C-Mn, C-Mn-Nb and C-Mn-V Heavy Structural Plate Steels with Improved Notch Toughness" (reference unknown).

ASTM Standard A572/A572M-88c, "Standard Specification for High-Strength Low-Alloy Columbium-Vanadium Steels of Structural Quality" (1988).

ASTM Standard A36/A36M-88c, "Standard Specification for Structural Steel" (1988).

ASTM Standard A529/A529M-88, "Standard Specification for Structural Steel with 42 ksi [290 Mpa] Minimum Yield Point (½ in. ]13 mm] Maximum Thickness" (1988).

*Primary Examiner*—Deborah Yee

[57] ABSTRACT

A fully killed steel has a composition of from about 0.005 to about 0.020 percent titanium and from about 0.004 to about 0.015 percent nitrogen, with the mole ratio of titanium to nitrogen being less than about 3.42. One grade of this steel exhibiting a 42 KSI minimum yield strength has from about 0.15 to about 0.27 percent carbon and from 0 to about 0.04 percent vanadium. Another grade exhibiting a 50 KSI minimum yield strength has from about 0.05 to about 0.27 percent carbon and at least about 0.02 percent vanadium. The balance of each steel is iron and other elements. Copper may optionally be provided for strength and corrosion resistance. The steel is prepared by continuous casting and hot rolling, without any quenching and tempering required to achieve the desired properties.

6 Claims, 2 Drawing Sheets

TITANIUM-BEARING LOW-COST STRUCTURAL STEEL

BACKGROUND OF THE INVENTION

This invention relates to steels, and, more particularly, to a steel that achieves good structural properties with low alloying and production costs.

Low-alloy steels are iron-based metallic alloys, containing additional alloying elements in amounts of up to about 2 percent by weight, that are used in a wide variety of applications. Such steels typically have good mechanical and physical properties, generally low cost, and a high degree of versatility. Their properties can be varied over wide ranges by varying the alloying elements and processing of the steel to its final form.

The present invention deals with steels used in structural applications, such as beams, plates, bars, and the like. Such steels have medium levels of alloying elements that are, on the whole, relatively inexpensive. They are processed by casting and hot rolling, sometimes with accelerated cooling after rolling to improve the final mechanical properties. The properties of the final processed steel pieces depend upon their composition, processing, and final thickness. Thinner sections usually have properties superior to those of otherwise identical, but thicker, sections.

To improve the uniformity of such steels for their users, standards have been established for these and other types of steels by organizations such as the American Society for Testing and Materials (ASTM). In some examples of interest here, ASTM Specification A36 sets forth the chemical and physical requirements for a "plain carbon" steel having a minimum yield point of 36 thousand pounds per square inch (KSI). This steel is inexpensive, having no expensive alloying elements and being processed by casting and hot rolling. ASTM A529 establishes standards for a somewhat similar grade of steel, except that this steel achieves a minimum yield point of 42 KSI in sections of maximum thickness ½ inch. ASTM A572 defines standards for steels that achieve specified minimum yield strengths such as 42 KSI or 50 KSI in thicker sections, but at the cost of the use of more expensive alloying additions such as vanadium or niobium. (There are, of course, many other grades of steels with other sets of properties, but the three standards just discussed are of the most interest in relation to the present invention.) Many suppliers of steel products can supply any or all of these grades, but at varying costs depending upon the cost of the alloying elements and the processing.

These standards are used by structural designers to order steels that meet particular strength requirements, at minimum cost. If, for example, the designer requires I-beams with only a 36 KSI yield point steel, then the most inexpensive grades meeting ASTM A36 can be used. If a 42 KSI yield point is required in a thin section, an ASTM A529 grade steel might be ordered. If a 42 or 50 KSI yield point is required in a thicker section, a more expensive steel meeting ASTM A572 would be specified.

The various steel standards typically specify property levels that must be attained and maximum levels of alloying elements, but not minimum levels of alloying elements. A continuing effort by steelmakers is therefore to develop steels that meet the property requirements of the standards, but with reduced cost as a consequence of reduced levels of the more expensive alloying elements. In particular, it would be desirable to develop a steel that meets ASTM A572 Grade 50 or ASTM A529/A572 Grade 42 properties, but at lower costs than possible with the existing steels used for these grades. The present invention provides such steels, and their processing.

SUMMARY OF THE INVENTION

The present invention provides steels that meet the ASTM A572 standard for a 50 KSI grade and the ASTM A529/A572 standard for a 42 KSI grade steel at a lower cost per ton than other steels used to meet these grade requirements. The steels are produced by continuous casting and hot rolling, and do not require any accelerated cooling after the hot rolling is complete. These steels can be substituted for existing steels but with lower costs, and also provide improved competitiveness for steels as compared with competing materials such as reinforced concrete in many applications.

In accordance with the invention, a steel meeting the ASTM A529/A572 Grade 42 specification has a composition of, in weight percent, from about 0.15 to about 0.27 percent carbon, from about 0.50 to about 1.5 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, from 0 to about 0.04 percent vanadium, and the remainder iron plus incidental impurities.

In accordance with another aspect of the invention, a steel meeting the ASTM A572 Grade 50 specification has a composition of, in weight percent, from about 0.05 to about 0.27 percent carbon, from about 0.50 to about 1.5 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, more than about 0.02 percent vanadium, and the remainder iron plus incidental impurities.

For each of these steel types, the mole ratio of titanium to nitrogen is less than about 3.42. There is more than about 0.005 percent aluminum to ensure that the steel is deoxidized to a "fully killed" state. The steel may optionally contain other elements that do not interfere with the strengthening mechanism resulting from the presence of the titanium, nitrogen, and vanadium in the steel. For example, the steel may contain copper, preferably in an amount of more than about 0.20 percent by weight, to contribute to solid solution strengthening and to improve the corrosion resistance of the steel where that is required for the application.

The steel is processed by continuous casting and hot rolling. Continuous casting results in a uniform distribution of small titanium nitride particles in the steel. "Hot rolling" refers to rolling above the austenite recrystallization temperature. For the slab reheating temperature and range of thickness considered, hot rolling refers to rolling above 1500 F.

In one preferred form of the invention, the steel has about 0.17 percent carbon, about 1.05 percent manganese, about 0.015 percent phosphorus, about 0.011 percent sulfur, about 0.22 percent silicon, about 0.012 percent titanium, and about 0.009 percent nitrogen. This steel meets the ASTM A529/A572, Grade 42 requirement in a hot-rolled steel.

In another preferred form, the steel has about 0.17 percent carbon, about 1.05 percent manganese, about 0.015 percent phosphorus, about 0.011 percent sulfur, about 0.22 percent silicon, about 0.012 percent titanium, about 0.011 percent nitrogen, and from about 0.02 to about 0.04 percent vanadium. This steel meets the ASTM A572, Grade 50 requirements for many common product sections in the hot-rolled condition. With about 0.02 percent vanadium, the steel meets these requirements in sections of up to about 1 inch in thickness. With about 0.04 percent vanadium, the steel meets these requirements in sections of up to at least 2 inches in thickness.

The present invention is an advance in the art of structural steels. This steel, having a low vanadium content and not requiring accelerated cooling after hot rolling, has a relatively low cost. It is estimated that the steel will have a cost about $2–3 per ton less than that of conventional higher-vanadium steels now used to meet the ASTM A572 specifications. The steel can be prepared in conventional mills with continuous casting and hot rolling. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
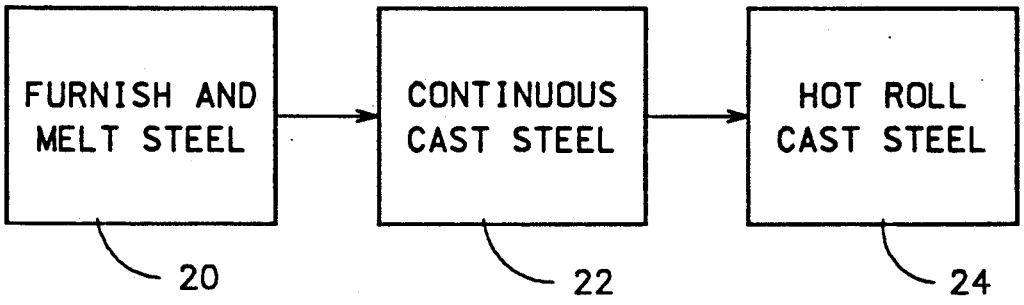
FIG. 1 is a block diagram for the process of the invention.

The present invention extends both to a composition of steel and its method of preparation. The steel of the invention has a composition of from about 0.005 to about 0.020 percent titanium and from about 0.004 to about 0.015 percent nitrogen, with the mole ratio of titanium to nitrogen being less than about 3.42. One grade of this steel exhibiting a 42 KSI minimum yield strength and meeting ASTM A529/A572, Grade 42 has from about 0.15 to about 0.27 percent carbon and from 0 to about 0.04 percent vanadium. Another grade exhibiting a 50 KSI minimum yield strength and meeting ASTM A572, Grade 50 has from about 0.05 to about 0.27 percent carbon and at least about 0.02 percent vanadium. Each of the steel types has from about 0.05 to about 1.5 percent manganese, less than about 0.04 percent phosphorus, less than about 0.05 percent sulfur, from about 0.1 to about 0.4 percent silicon, more than about 0.005 percent aluminum, and the remainder iron plus incidental impurities. (All compositions herein are in weight percent, unless indicated otherwise.)

If the carbon, manganese, or silicon contents are below the respective indicated levels for each grade, the steel does not achieve the strength requirements of the respective specification. If the carbon, manganese, or silicon contents are above the indicated levels, the steel exceeds the permitted levels of the respective specification and is therefore technically and commercially unacceptable.

The titanium and nitrogen in the steel are intended to form titanium nitride particles of a size of about 20–60 nanometers that are dispersed throughout the steel and strengthen it by restricting austenite grain growth during processing. A small austenite grain size is desirable, as it leads to a small ferrite grain size in the final product, and the small ferrite grain size contributes to improved strength and toughness of the final product. If the titanium content is too low, an insufficient number of the titanium nitride particles are formed. If the titanium content is too high, coarse titanium nitride particles form in the liquid state. These coarse titanium nitride particles act as inclusions in the steel, degrading its toughness. The coarse titanium nitride particles also are not effective for restricting austenite grain growth during processing.

The lower limit of the nitrogen in the steel depends upon the processing to be used. Because the TiN particles are relatively stable at low nitrogen levels when reheating at temperatures of 2300 F. and less, a low level of about 0.004 percent nitrogen is sufficient to achieve the desired grain refinement necessary to meet the yield strength requirement. When the reheating temperature exceeds about 2300 F., some of the TiN particles can dissolve, and austenite grain growth occurs. Excess nitrogen is necessary to stabilize the TiN particles to ensure a fine grain size when using reheating temperatures from 2300 F. to 2500 F. or more.

The mole ratio of titanium to nitrogen should be less than about 3.42. For example, if the titanium content is about 0.015 percent, the nitrogen should be present in an amount of at least about 0.004 percent (40 parts per million). The presence of excess nitrogen minimizes the amount of dissolved titanium in the final product, and hence the coarsening of the titanium nitride particles during slab reheating for hot rolling and subsequent processing.

Additional nitrogen is provided in the steel above that required for titanium nitride formation. Nitrogen, along with manganese, silicon, and copper, when used, produces solid solution strengthening. Sufficient excess nitrogen is provided to react with vanadium, where provided, to permit the formation of vanadium carbonitrides, as will be discussed subsequently. Taking these other effects of nitrogen into account, the minimum nitrogen content has been established at about 0.004 percent. The nitrogen content should not exceed about 0.015 percent, as amounts of nitrogen exceeding 0.015 percent can cause the extensive precipitation of coarse titanium nitride particles in the liquid prior to casting. The coarse titanium nitride particles are retained into the solid state and final product, and may reduce the fracture toughness of the steel.

Vanadium, a relatively expensive element, is added to the steel sparingly and only as necessary to meet property requirements. No vanadium is required for the steel of the invention to meet the ASTM A529/A572 Grade 42 strength requirement in the hot-rolled condition, although vanadium may be added to ensure a sufficient margin above the requirement in thicker sections. Sufficient vanadium and nitrogen are added to meet the yield strength requirement of the ASTM A572 Grade 50 steel. The vanadium reacts with the carbon and nitrogen present in the steel to produce fine vanadium carbonitride particles on the order of about 3–10 nanometers in size that have a strong influence on the strength of the steel. It has been found that a vanadium addition of about 0.02 percent is required to meet the ASTM A572 Grade 50 specification in final sections up to about 1 inch thick, and that about 0.04 percent is required to meet the specification in final sections of about 1 to at least 2 inches thick.

The steel is "fully killed", a well known steelmaking condition wherein the oxygen in the steel is removed. Excessive free oxygen may not be present in the steel, as it reacts with the titanium to form titanium oxide. The titanium is therefore not available to form the desired titanium nitride particulate. To fully kill the steel, the oxygen may be removed by vacuum processing, but is more economically removed by adding a strong oxide former such as aluminum. In the present steel, there is more than about 0.005 percent aluminum to ensure that the steel is deoxidized to a "fully killed" state.

The steel may optionally contain other elements that do not interfere with the strengthening mechanism resulting from the titanium, nitrogen, and vanadium in the steel. ASTM A529 and A572 permit the steel to contain copper for corrosion resistance. To be consistent with this requirement of the specification, the steel may contain copper, preferably in an amount of more than about 0.20 percent by weight, to improve the corrosion resistance of the steel where that is required for the design application.

The remainder of the steel is iron and incidental elements that are often present in conventional steelmaking practice.

The steel according to the invention is melted according to conventional practice, numeral 20 of FIG. 1. In the preferred approach the steel is melted in a basic oxygen furnace. Other steelmaking practices such as electric furnace and DC plasma arc are acceptable.

The steel is cast, numeral 22, at a cooling rate sufficient to produce a fine dispersion of titanium nitride particles throughout the steel upon solidification. In commercial practice, the steel is continuously cast with a slab, bloom, billet, or near-net-shape caster to produce a center solidification rate of at least about 5 degrees F. per minute.

The cast steel is reheated if necessary in a reheat furnace and then hot rolled using an acceptable hot rolling practice, numeral 24. The hot rolling procedure may be conventional practice wherein the temperature of the steel is not controlled. (The control-finish temperature ("CFT") process, wherein the temperature of the steel is maintained such that it emerges from the final pass at a preselected temperature, is within the scope of "hot rolling" as that term is used herein). The final rolling temperature is above the austenitic recrystallization temperature. The steel is hot rolled to a required section thickness. Thickness limitations to meet property requirements have been discussed previously in relation to the composition of the steel.

The following examples are intended to illustrate aspects of the invention, but should not be taken as limiting of the invention in any respect.

EXAMPLE I

A "base" steel and five modified steels were prepared. The "base" steel is typical of that produced for plates required to meet the ASTM A36 specification. Its composition in weight percent is about 0.17 percent carbon, about 1.05 percent manganese, about 0.015 percent phosphorus, about 0.011 percent sulfur, about 0.22 percent silicon, about 0.05 percent aluminum, about 0.0040 percent nitrogen, balance iron and incidental impurities. A "Ti" steel was prepared with about 0.015 percent titanium added to the base composition. A "Ti-N" steel was prepared with about 0.015 percent titanium and about 0.0120 percent nitrogen. A "Ti-0.02V-N" steel was prepared with about 0.015 percent titanium, about 0.0120 percent nitrogen, and about 0.02 percent vanadium added to the base composition. A "Ti-0.04V-N" steel was prepared with about 0.015 percent titanium, about 0.0120 percent nitrogen, and about 0.04 percent vanadium added to the base composition. A "0.08V" steel was prepared with about 0.08 percent vanadium added to the base composition. Each steel was vacuum melted and cast as ingots 8½ inches square and 20 inches long. The casting was controlled to have a cooling rate that approximates that of continuous casting.

The ingots were heated to 2300 F. for three hours and hot rolled to billets that were either 4 inches thick and 5 inches wide, or 6 inches thick and 5 inches wide. Pieces were cut from these billets and hot rolled to plate thicknesses of 0.25, 0.50, 1.0, and 2.0 inches. The 2.0 inch thick plates were rolled from the 6 inch thick billets, and the other plates were rolled from the 4 inch thick billets. The billets were rolled by conventional hot rolling with final rolling temperatures above 1500 F.

The following table summarizes the results of physical testing of the six hot-rolled test steels. In the table, the first column is the thickness of the plate in inches, the second column is the designation of the steel, the third column is yield strength in KSI, the fourth column is ultimate tensile strength in KSI, the fifth column is percent elongation to failure in a 2 inch gage length, the sixth column is reduction in area at failure, and the seventh and eighth columns are the average Charpy V-notch energy in foot-pounds at −20 F. and +40 F., respectively. (Charpy V-notch (CVN) energy values have been normalized to full-size values; that is, for example, half-size CVN energy values were doubled, according to the standard approach.)

TABLE I

| Plate | | | | | | Avg. CVN | |
|---|---|---|---|---|---|---|---|
| Thck | Steel | YS | UTS | Elon | RA | −20F | +40F |
| ¼ | Base | 50.5 | 69.9 | 32.8 | 65.1 | 70.5 | 73.5 |
| | Ti | 55.0 | 72.1 | 30.3 | 58.8 | 56.5 | 71.5 |
| | Ti—N | 53.3 | 73.4 | 31.3 | 64.2 | 53.0 | 57.0 |
| | Ti—.02V—N | 56.7 | 76.6 | 29.0 | 57.2 | 50.5 | 52.5 |
| | Ti—.04V—N | 63.5 | 83.1 | 26.3 | 57.7 | 25.5 | 52.0 |
| | 0.08V | 68.2 | 85.9 | 27.0 | 60.1 | 9.5 | 49.5 |
| ½ | Base | 46.0 | 67.7 | 37.0 | 65.7 | 149.5 | >240. |
| | Ti | 48.4 | 69.1 | 37.0 | 64.5 | 97.5 | 154.0 |
| | Ti—N | 49.0 | 71.4 | 36.0 | 63.6 | 63.5 | 141.5 |
| | Ti—.02V—N | 52.9 | 74.3 | 33.5 | 62.2 | 64.5 | 122.0 |
| | Ti—.04V—N | 59.0 | 79.9 | 32.0 | 60.7 | 53.0 | 97.0 |
| | 0.08V | 61.4 | 82.7 | 32.3 | 63.2 | 65.0 | 96.5 |

TABLE I-continued

| Plate Thck | Steel | YS | UTS | Elon | RA | Avg. CVN −20F | Avg. CVN +40F |
|---|---|---|---|---|---|---|---|
| 1 | Base | 42.9 | 66.6 | 34.0 | 69.1 | >158. | >243. |
| | Ti | 46.2 | 68.2 | 33.0 | 66.8 | 63.5 | 138.5 |
| | Ti—N | 46.8 | 70.2 | 33.0 | 65.1 | 75.5 | 114.0 |
| | Ti—.02V—N | 50.6 | 73.2 | 31.5 | 64.3 | 57.5 | 108.0 |
| | Ti—.04V—N | 55.7 | 79.6 | 29.5 | 61.9 | 56.5 | 80.5 |
| | 0.08V | 58.1 | 84.3 | 28.5 | 63.2 | 48.5 | 83.5 |
| 2 | Base | 39.6 | 66.4 | 35.8 | 69.8 | 130.0 | >246. |
| | Ti | 43.8 | 64.4 | 33.5 | 67.1 | 34.0 | 121.0 |
| | Ti—N | 44.6 | 70.3 | 33.3 | 65.5 | 30.0 | 111.5 |
| | Ti—.02V—N | 48.1 | 73.1 | 32.0 | 65.7 | 17.5 | 85.5 |
| | Ti—.04V—N | 55.3 | 80.1 | 29.3 | 62.2 | 28.5 | 76.5 |
| | 0.08V | 56.5 | 83.3 | 28.5 | 64.6 | 47.5 | 82.0 |

Figure 2:
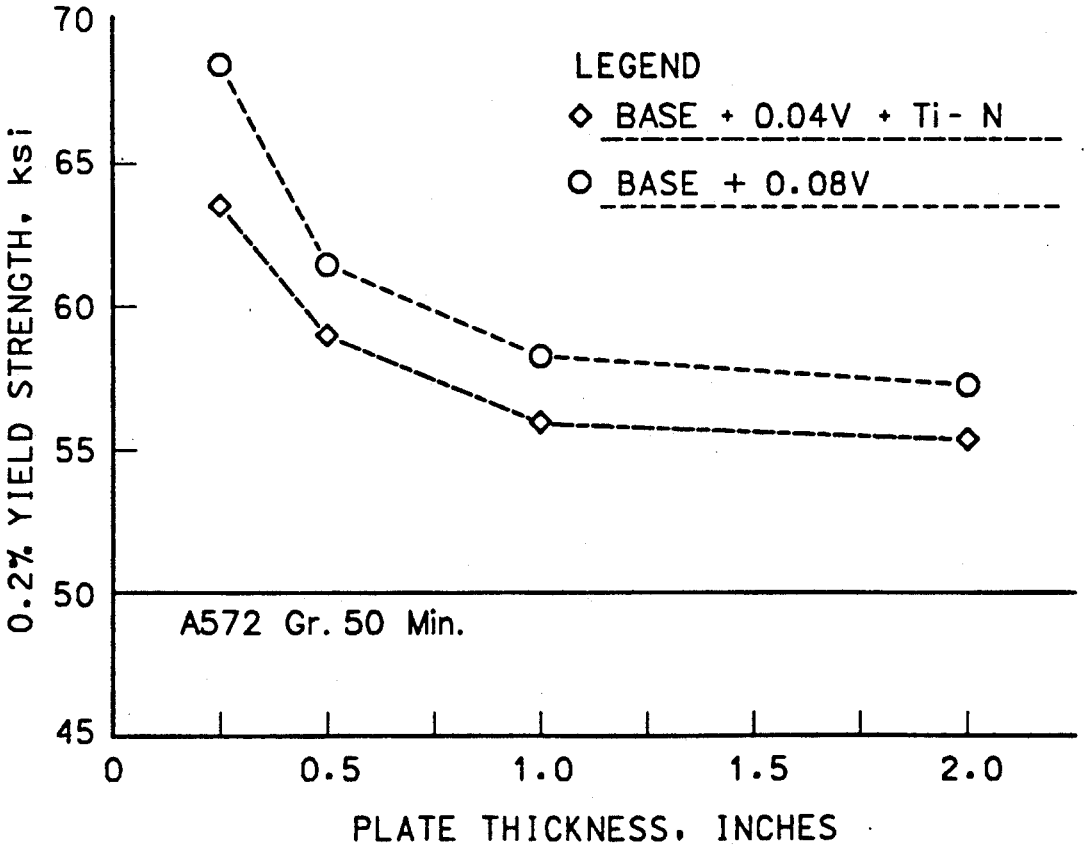
FIG. 2 is a graph of yield strength as a function of section thickness for a steel of the invention, in relation to the standard of ASTM A572 Grade 50.

These results, in pertinent part summarized in FIG. 2, demonstrate that to meet the 50 KSI minimum yield strength of ASTM A572, Grade 50 in sections up to at least 2 inches thickness, titanium, extra nitrogen, and at least about 0.04 percent vanadium must be added to the base steel. An addition of 0.02 percent vanadium and extra nitrogen provides a minimum yield strength of 50 KSI for section thicknesses up to about 1 inch, but not in thicker sections. An addition of a total of 0.08 V produces a steel that substantially exceeds the standard. Because of the high cost of vanadium, such a steel that substantially exceeds the standard is not within the scope of the invention.

Figure 3:
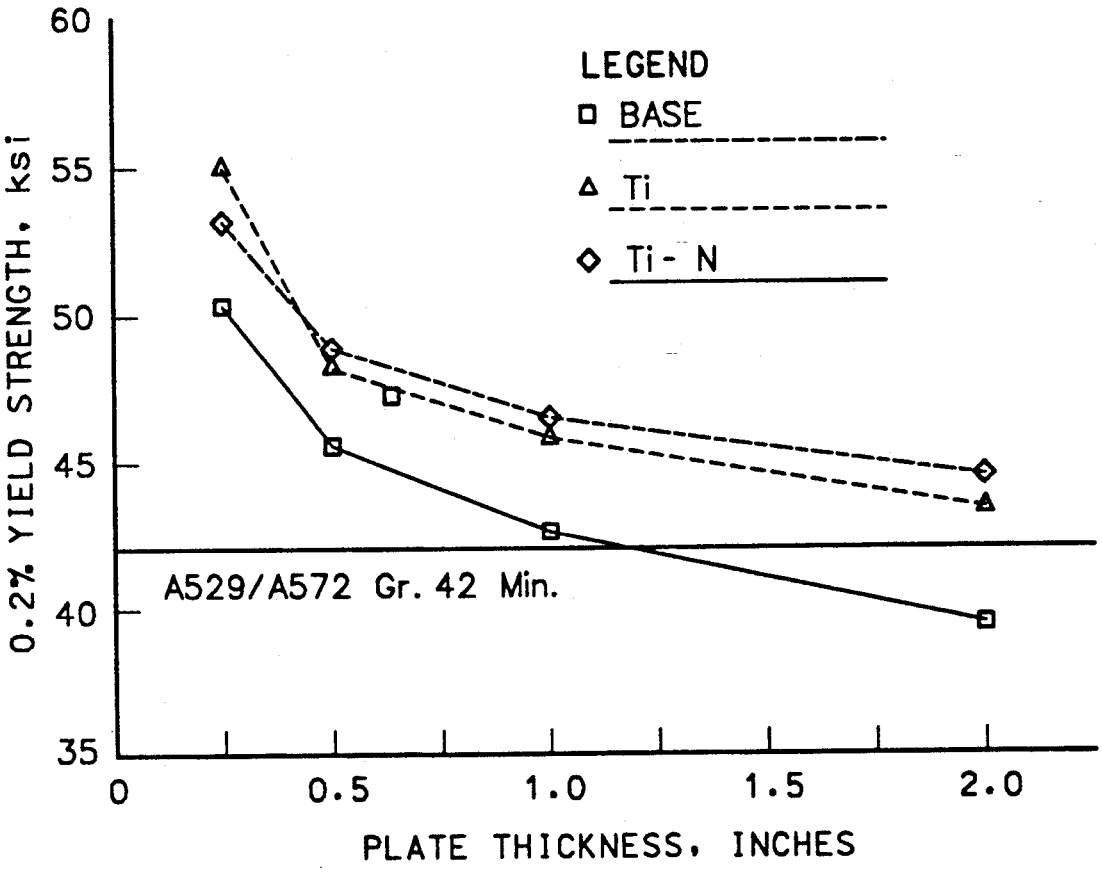
FIG. 3 is a graph of yield strength as a function of section thickness for two steels of the invention, in relation to the standard of ASTM A529/A572 Grade 42.

To meet the 42 KSI minimum yield strength of ASTM A529/A572, Grade 42 in sections up to 2 inches in thickness, as summarized in FIG. 3 only a small addition of titanium is required to the base steel. To ensure a minimum yield strength of 42 KSI in thicker sections (especially if reheating temperatures in the range of 2300 F. to 2500 F. are to be utilized), an addition of nitrogen may be needed.

EXAMPLE II

To verify these results in relation to the ASTM A529/A572, Grade 42 steels, a 270 ton heat of steel was produced in a basic oxygen furnace with the following composition in weight percent: 0.15 percent carbon, 0.89 percent manganese, 0.012 percent phosphorus, 0.009 percent sulfur, 0.24 percent silicon, 0.01 percent copper, 0.014 percent titanium, 0.041 percent aluminum, and 0.006 percent nitrogen, balance iron and incidental impurities. This steel, termed "A36+Ti", was continuously cast to 10 inch thick slabs, reheated to about 2350 F., and hot-rolled to various plate thicknesses. Typical mechanical properties from these plates are compared to those of similar companion plates which did not have the titanium addition and which are termed "A36". In the following Table II, the first column is the grade of steel, the second column is the thickness of the plate tested, the third column is the yield strength in KSI, the fourth column is the ultimate tensile strength in KSI, and the fifth column is the percent elongation. The gate length for the percent elongation was 8 inches for plate thicknesses of 0.5 and 0.75 inches, and 2 inches for plates of 1.125 and 2 inches thickness.

TABLE II

| Steel | Thck, in | YS,KSI | UTS,ksi | % Elong |
|---|---|---|---|---|
| A36 | 0.5 | 41.8 | 64.7 | 30.0 |
| A36 + Ti | 0.5 | 45.3 | 67.6 | 30.0 |
| A36 | 0.75 | 40.6 | 63.7 | 28.0 |
| A36 + Ti | 0.75 | 44.8 | 66.4 | 28.0 |
| A36 | 1.125 | 39.3 | 62.7 | 35.0 |
| A36 + Ti | 1.125 | 41.8 | 66.4 | 34.0 |
| A36 | 2.0 | 37.5 | 63.1 | 33.0 |
| A36 + Ti | 2.0 | 40.5 | 65.6 | 30.0 |

In comparison with the A36 steel, the A36+Ti steel with 0.014 percent titanium provides an average increase in yield strength of 3.5 KSI, which is consistent with the results in Example I. For a given plate thickness, the plates of this Example II produced in a large-size heat exhibit yield strengths of about 2 KSI below those produced in smaller heats, Example I. This difference is attributed to the lower manganese and nitrogen contents of the plates of Example II. Suitable increases in manganese (e.g., to about 1.05 percent) and nitrogen (e.g., to about 0.009 percent) should ensure that the minimum yield strength requirement of 42 KSI is met in the thicker sections.

In summary, the steels of the invention provide an advance in the art of structural steels. Steels that meet existing specifications can be produced less expensively than existing steels that meet the specifications, by carefully adjusting the additions of further alloying elements to conventional steels. Although a particular embodiment of the invention has been described in detail for purposes of illustration, various modifications may be made without departing from the spirit and scope of the invention. Accordingly, the invention is not to be limited except as by the appended claims.

What is claimed is:

1. A fully killed steel consisting essentially of, in weight percent, from about 0.15 to about 0.27 percent carbon, from about 0.5 to about 1.5 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, with the mole ratio of titanium to nitrogen being less than about 3.42, from about 0.02 to about 0.04 percent vanadium, and the remainder iron plus incidental impurities.

2. The steel of claim 1, wherein the composition of the steel comprises about 0.17 percent carbon, about 1.05 percent manganese, about 0.015 percent phosphorus, about 0.011 percent sulfur, about 0.22 percent silicon, about 0.012 percent titanium, and about 0.009 percent nitrogen.

3. The steel of claim 1, wherein the composition of the steel comprises about 0.17 percent carbon, about 1.05 percent manganese, about 0.015 percent phosphorus, about 0.011 percent sulfur, about 0.22 percent silicon, about 0.012 percent titanium, about 0.011 percent nitrogen, and from about 0.02 to about 0.04 percent vanadium.

4. A fully killed steel consisting essentially of, in weight percent, from about 0.15 to about 0.17 percent carbon, from about 0.50 to about 1.50 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, with the mole ratio of titanium to nitrogen being less than about 3.42, and the remainder iron plus incidental impurities.

5. The steel of claim 4, wherein the steel contains from about 0.012 to about 0.015 percent phosphorus, from about 0.009 to about 0.011 percent sulfur, from about 0.22 to about 0.24 percent silicon, from about 0.014 to about 0.015 percent titanium.

6. A fully killed steel consisting essentially of, in weight percent, from about 0.15 to about 0.17 percent carbon, from about 0.50 to about 1.50 percent manganese, less than about 0.04 percent phosphorus, less than about 0.05 percent sulfur, from about 0.1 to about 0.4 percent silicon, from about 0.014 to about 0.015 percent titanium, from about 0.012 to about 0.015 percent nitrogen, with the mole ratio of titanium to nitrogen being less than about 3.42, and the remainder iron plus incidental impurities.

* * * * *